United States Patent [19]

Richard

[11] Patent Number: 5,009,432

[45] Date of Patent: Apr. 23, 1991

[54] ROPING PRACTICE APPARATUS

[76] Inventor: David L. Richard, Rte. 5, Box 3675, Choupique Rd., Sulphur, La. 70663

[21] Appl. No.: 590,724

[22] Filed: Oct. 1, 1990

[51] Int. Cl.[5] ..... A63B 69/00

[52] U.S. Cl. ..... 273/339; 273/359

[58] Field of Search ..... 273/339, 359, 336, 337, 273/338

[56] References Cited

U.S. PATENT DOCUMENTS

| | | | |
|---|---|---|---|
| 3,066,939 | 12/1962 | Sprout | 273/338 |
| 3,711,098 | 1/1973 | McCord | 273/336 |
| 3,776,553 | 12/1973 | Kelton | 273/339 |
| 3,802,706 | 4/1974 | Hamm | 273/339 |
| 3,947,033 | 3/1976 | Bennett | 273/339 |
| 4,136,874 | 1/1979 | McCord | 273/339 |
| 4,364,570 | 12/1982 | Hallam | 273/338 |
| 4,451,045 | 5/1984 | Fesmire | 273/338 |
| 4,498,676 | 2/1985 | Runner | 273/336 |
| 4,640,515 | 2/1987 | Rhine | 273/339 |
| 4,662,642 | 5/1987 | Archibald et al. | 273/339 |
| 4,874,179 | 10/1989 | Henderson | 273/338 |

*Primary Examiner*—William H. Grieb

*Attorney, Agent, or Firm*—Henderson & Sturm

[57] ABSTRACT

A roping practice apparatus (10) including a wheeled support unit (11) for a hinged torso unit (12) equipped with a quick release unit (13). The front (20) and rear (30) torso members of the torso unit (12) are movably connected to one another and operatively associated with a cable actuator member (41) which is responsive to an outside force exerted on portions of either the front (20) and rear (30) torso members to actuate a quick release member (40).

5 Claims, 2 Drawing Sheets

ROPING PRACTICE APPARATUS

TECHNICAL FIELD

The present invention relates to the field of cattle roping practice devices in general, and in particular to a roping practice device that employs pivoted and suspended rear legs.

BACKGROUND ART

This invention was the subject matter of Document Disclosure Program Registration No. 243,568 which was filed in the United States Patent and Trademark Office on Jan. 18, 1990.

As can be seen by reference to the following U.S. Pat. Nos. 3,947,033; 3,776,553; 4,136,874; and 4,662,642; the prior art is replete with myriad and diverse cattle roping practice apparatus having moveably disposed simulated rear legs.

While all of the aforementioned prior art constructions are more than adequate for the basic purpose and function for which they have been specifically designed, these patented structures have been uniformly remiss in simulating the action of a live animal once the horns or the legs of the simulated animal have been captively engaged by a rope.

Virtually none of the prior art devices have a quick release mechanism for disengaging the simulated animal from a towing vehicle once the head or one of the legs of the device has been restrained by a rope; such that the simulated animal would react in virtually the same manner as a live animal would respond once its freedom of movement had been curtailed under actual roping conditions.

As a consequence of the foregoing situation, there has existed a longstanding need for an improved roping practice apparatus that is responsive to the force exerted by a rope on the apparatus to activate a quick release mechanism to disengage the apparatus from a towing vehicle to produce realistic action, and the provision of such a construction is a stated objective of the present invention.

DISCLOSURE OF THE INVENTION

Briefly stated, the roping practice apparatus that forms the basis of the present invention comprises a wheeled support unit which carries a hinged animal torso unit. In addition, the wheeled support unit is provided with a quick release unit that operatively, yet releasably, connects the apparatus to a towing vehicle or the like which is used to impart movement to the apparatus.

Furthermore, the hinged animal torso unit is provided with a plurality of structural components that are movable with respect to one another. All of the movable components are operatively connected to a cable unit having one end attached to the quick release unit to effect the disengagement of the apparatus from the towing vehicle.

As will be explained in greater detail further on in the specification, the hinged animal torso unit comprises a front torso member that is hingedly connected to a rear torso member whereby the displacement of the front torso member relative to the rear torso member under the influence of a rope will create tension in the cable unit that will activate the quick release unit.

Likewise, the rear torso member is provided with a pair of independently suspended leg elements each operatively connected to the cable unit whereby the forceable rearward movement of either or both of the leg elements captively engaged by a rope will also create tension in the cable unit to disengage the apparatus from a towing vehicle.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
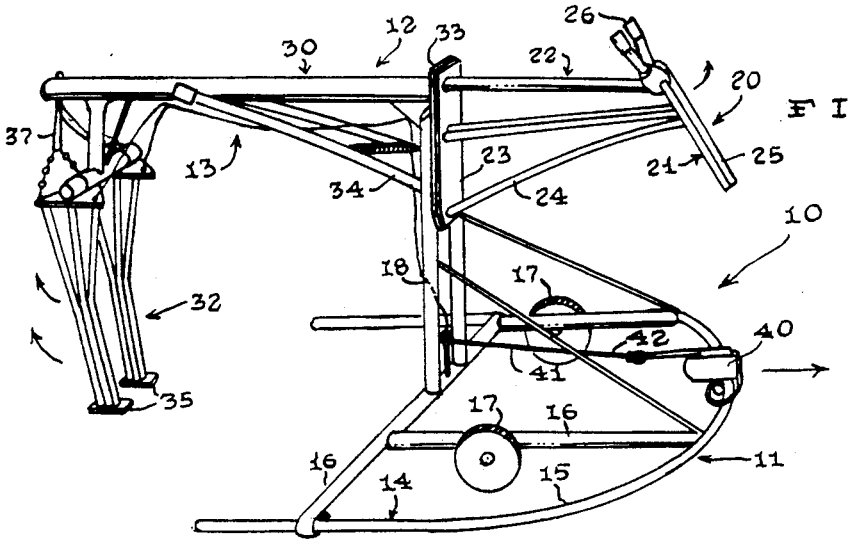
FIG. 1 is a perspective view of the roping practice apparatus.

As can be seen by reference to the drawings, and in particular to FIG. 1, the roping practice apparatus that forms the basis of the present invention is designated generally by the reference numeral (10). The apparatus (10) comprises in general, a wheeled support unit (11), a hinged animal torso unit (12) and a quick release unit (13). These units will now be described in seriatim fashion.

Figure 2:
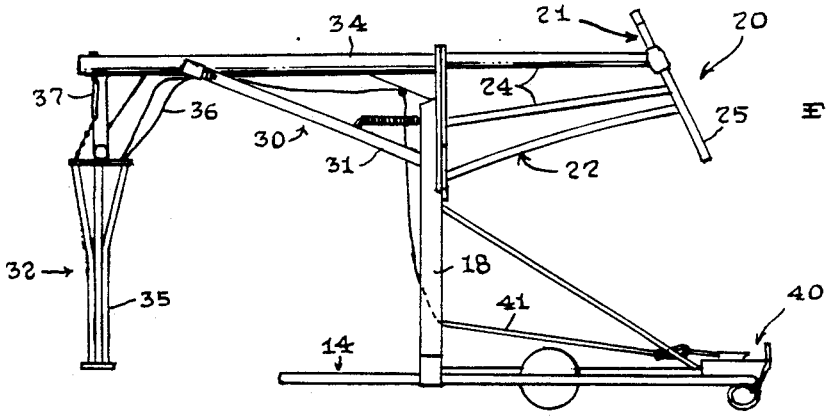
FIG. 2 is a side plan view of the apparatus.

As can best be seen by reference to FIGS. 1 and 2, the wheeled support unit comprises a generally U-shaped open framework sled (14) including a generally arcuate outer framework element (15) provided with stiffening members (16) and a plurality of wheels (17) which are operatively connected to the sled (14) in a well recognized manner to permit an external force to impart rolling movement of the sled (14) along the ground.

As can also be seen by reference to FIGS. 1 and 2, the wheeled support unit (11) further comprises a pair of vertically disposed support columns (18) which project upwardly from the sled (14) and provide support for the hinged animal torso unit (12).

The hinged animal torso unit (12) comprises a front torso member (20) which simulates the head (21) and neck (22) of a horned steer, or other animal. The front torso member (20) includes a first shoulder plate element (23) having a first open tubular framework (24) projecting forwardly therefrom and provided on its front end with a face plate element (25) equipped with a pair of outwardly projecting simulated horns (26).

Still referring to FIGS. 1 and 2, it can be seen that the hinged animal torso unit (12) also comprises a rear torso member (30) which simulates the body (31) and rear legs (32) of an animal wherein the rear torso member (30) includes a second shoulder plate element (33) having a second open tubular framework (34) projecting rearwardly therefrom, and provided on its rear end with a pair of pivotally mounted independently suspended leg elements (35).

Figure 3:
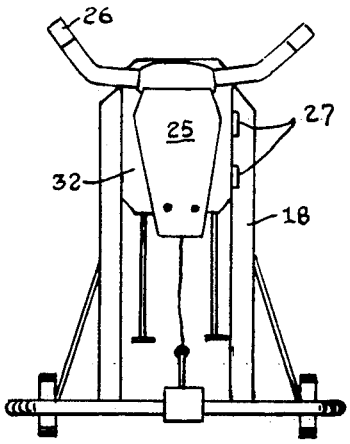
FIG. 3 is a front plan view.
Figure 4:
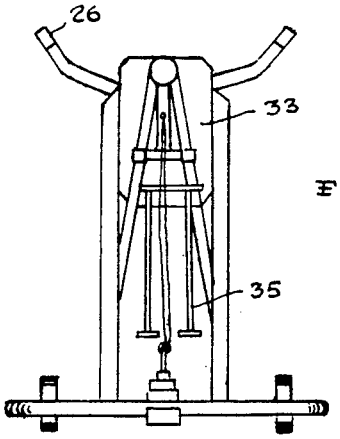
FIG. 4 is a rear plan view.

Furthermore, as shown in FIGS. 3 and 4, the second shoulder plate element (33) of the rear torso member (30) is fixedly connected to the vertical support columns (18) of the wheeled support unit (11). The support columns (18) represent the front legs of the simulated animal and the first shoulder plate element (23) of the front torso member (20) is movably connected relative to the rear torso member (30) such as by hinges (27) disposed along one side of the first shoulder plate element (23) for reasons that will be explained presently.

Figure 6:
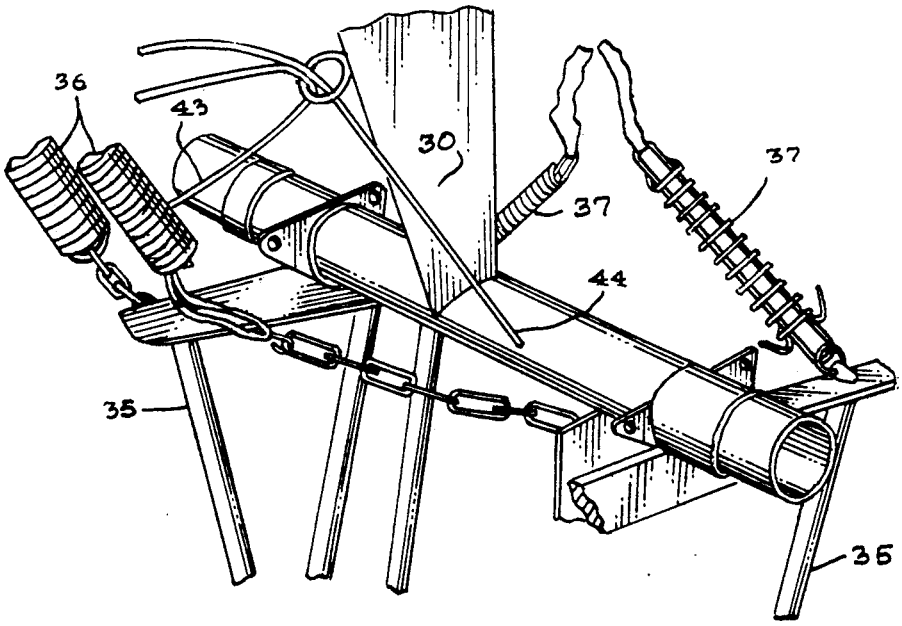
FIG. 6 is an enlarged detail view of the leg connected release actuating mechanism.

Turning now to FIG. 6, it can be seen that the independently suspended leg elements (35) on the rear portion of the rear torso member (30) are provided with front and rear spring biasing elements (36, 37) to limit the arcuate forward and rearward movement of the individual leg elements (35). The front spring elements (36) are stiffer than the rear spring elements (37) for reasons that will be explained presently.

Referring back to FIGS. 1 and 2, it can be seen that the quick release unit (13) comprises a conventional quick release latch member (40) mounted on the front of the sled (14) wherein the latch member (40) is intended to be operatively, yet releasably, attached to a towing cable (not shown) that will pull the apparatus (10) along the ground.

In addition, the quick release unit (13) further comprises a main cable actuator member (41) which will trigger the quick release latch member (40) in a well recognized fashion when a certain amount of tension is exerted for the cable actuator member (41).

As can be seen by reference to FIGS. 1, 2 and 6, the cable actuator member (41) is operatively attached on one end (42) to the quick release actuator member (40) and extends rearwardly along the sled (14), upwardly in close proximity to the second shoulder plate element (33), rearwardly along the second open tubular framework (34), and depends downwardly in a bifurcated fashion wherein each of the bifurcated ends (43, 44) are attached to one of the independently supported pivoted leg elements (35). It should further be noted that there is only a very limited amount of slack along the length of the cable actuator member (41) between the quick release actuator member (40) and each of the leg elements (35).

Figure 5:
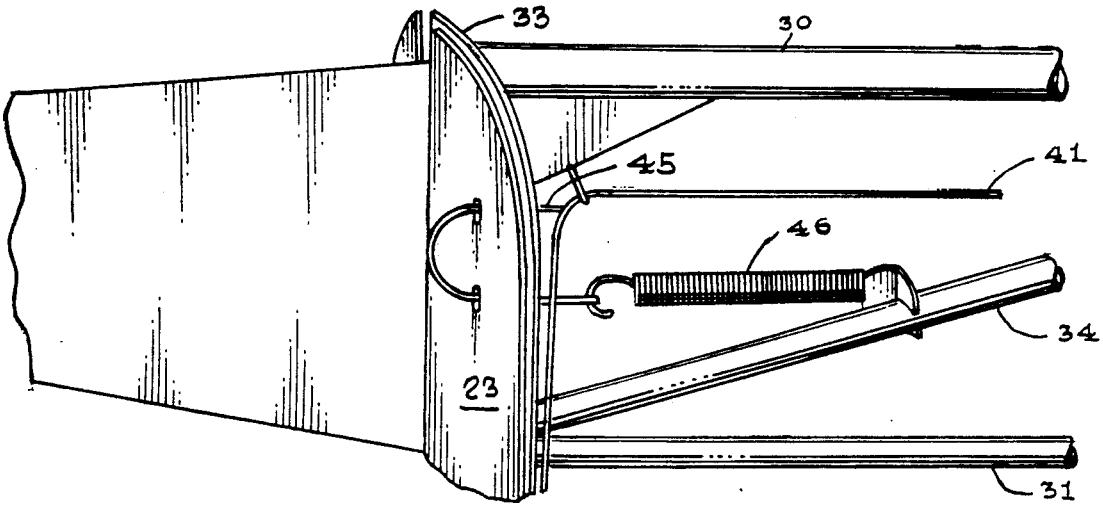
FIG. 5 is an enlarged detail view of the head connected release actuating mechanism.

Turning now to FIGS. 1, 2 and 5, it can be seen that the cable actuator member (41) is further provided with an auxiliary cable actuator element (45) which is connected on one end to the first shoulder plate element (23) and operatively attached to the cable actuator member (41). The movement of the first shoulder plate element (23) relative to the second shoulder plate element (33) will be transmitted through the auxiliary cable actuator element (45) to activate the quick release member (40). It should also be noted that the auxiliary cable actuator element (45) is spring biased towards the second shoulder plate element (33) by virtue of a helical spring (46) that connects the auxiliary cable actuator element (45) to the second open framework (34).

Now when the head (21), neck (22), or horns (26) of the apparatus (10) is lassoed or roped and pulled to the left, as is done in heading and heeling, the first and second shoulder plate elements (23, 33) will be spread apart as depicted in FIG. 5 to actuate the quick release member (40).

In addition, when either or both of the independently suspended leg elements (35) are roped and a rearward force is applied against one or more of the heavier front spring biasing elements (36), that force will likewise be transmitted through the main cable actuator member (41) to actuate the quick release member (40).

By now it should be appreciated that apparatus (10) described herein can be used both by headers and heelers either alone or in combination with one another to practice team roping without the need to employ a live animal.

Having thereby described the subject matter of the present invention, it should be apparent that many substitutions and variations of the invention are possible in light of the above teachings. It is therefore to be understood that the invention as taught and described herein is only to be limited to the extent of the breadth and scope of the appended claims.

I claim:

1. A roping practice apparatus for teaching team roping to heelers and headers wherein, the apparatus comprises:

a wheeled support unit having at least one vertically disposed support column;

a rear torso member fixedly secured to said at least one support column; wherein said rear torso member is further provided with at least one pivoted leg element;

a quick release unit comprising a conventional quick release member disposed on said wheeled support unit and further provided with a main cable actuator member which extends from said quick release member to said at least one pivoted leg element.

2. The apparatus as in claim 1 wherein said rear torso member is provided with a pair of pivoted independently supported leg elements.

3. The apparatus as in claim 2 wherein said cable actuator member has a bifurcated end where each one of the bifurcated ends is attached to one of said independently supported leg elements.

4. The apparatus as in claim 1 further comprising:

a front torso member movably associated with said rear torso member.

5. The apparatus as in claim 4 wherein said quick release unit further comprises:

an auxiliary cable actuator element secured on one end to said front torso member and operatively attached to said main cable actuator member, wherein the movement of the front torso member relative to the rear torso member will cause the main cable actuator member to actuate the quick release member.

* * * * *